US008127950B2

(12) United States Patent
Glickman et al.

(10) Patent No.: US 8,127,950 B2
(45) Date of Patent: Mar. 6, 2012

(54) INDEPENDENTLY POWERED TROLLEYS

(75) Inventors: Myron Glickman, Arlington Heights, IL (US); Matthew M. Moran, Woodridge, IL (US); Daniel Brian Zakula, Sr., Mokena, IL (US)

(73) Assignee: Mi-Jack Products, Inc., Hazel Crest, IL (US)

( * ) Notice: Subject to any disclaimer, the term of this patent is extended or adjusted under 35 U.S.C. 154(b) by 0 days.

(21) Appl. No.: 12/643,025

(22) Filed: Dec. 21, 2009

(65) Prior Publication Data

US 2011/0147330 A1 Jun. 23, 2011

(51) Int. Cl.
*B66C 17/00* (2006.01)

(52) U.S. Cl. ..... 212/316; 212/344

(58) Field of Classification Search ..... 212/316, 212/343–345, 197
See application file for complete search history.

(56) References Cited

U.S. PATENT DOCUMENTS 3,433,366 A 3/1969 Brazell et al.
3,994,401 A 11/1976 Tax et al.
4,653,653 A 3/1987 Scott
5,037,045 A * 8/1991 Wakabayashi ..... 246/167 D
5,425,464 A * 6/1995 Hannen et al. ..... 212/197
5,539,987 A * 7/1996 Zennyoji ..... 33/1 M
6,956,339 B1 10/2005 Kureck et al.
2007/0095776 A1* 5/2007 Wierzba et al. ..... 212/344

FOREIGN PATENT DOCUMENTS

JP 2-144306 A * 6/1990

OTHER PUBLICATIONS

International Search Report and Written Opinion issued in related international application No. PCT/US2010/061460, Feb. 14, 2011, 15 pages.

* cited by examiner

*Primary Examiner* — Emmanuel M Marcelo
(74) *Attorney, Agent, or Firm* — Drinker Biddle & Reath LLP

(57) ABSTRACT

A trolley control system for a gantry crane having a multiple trolley arrangement such as a first and second trolley. The control system including a trolley beam connected to the gantry crane with a first and second drive device connected to the trolley beam. The first drive device is powered by a first drive system while the second drive device can be powered by either the first drive system or the second drive system. A first trolley is connected to the first drive device while a second trolley is connected to the second drive device.

21 Claims, 8 Drawing Sheets

| Operation | First Motor 1 | First Clutch 1 | First Brake 1 | First Drive Sprocket | Second Motor 2 | Second Clutch 2 | Second Brake 2 | Second Drive Sprocket |
|---|---|---|---|---|---|---|---|---|
| Second Trolley and First Trolley Moving Together | Driving | Engaged | Released | Driven | Stationary | Disengaged | Released | Driven |
| First Trolley Moving, Second Trolley Stationary | Driving | Disengaged | Released | Driven | Stationary | Engaged | Applied | Stationary |
| Second Trolley Moving, First Trolley Stationary | Stationary | Disengaged | Applied | Stationary | Driving | Engaged | Released | Driven |

FIG. 3

| Operation | First Motor | First Brake | Second Motor | Second Brake | Comment |
|---|---|---|---|---|---|
| First Trolley and Second Trolley Moving Together | Driving | Released | Driving | Released | Electronic Synchronized Required |
| First Trolley Moving, Second Trolley Stationary | Driving | Released | Stationary | Applied | |
| First Trolley Stationary, Second Trolley Moving | Stationary | Applied | Driving | Released | |

FIG. 5

| Operation | Motor | Clutch 1 | Clutch 2 | Brake 1 | Brake 2 |
|---|---|---|---|---|---|
| First Trolley and Second Trolley Moving Together | Driving | Engaged | Engaged | Released | Released |
| First Trolley Moving, Second Trolley Stationary | Driving | Engaged | Disengaged | Released | Applied |
| First Trolley Stationary, Second Trolley Moving | Driving | Disengaged | Engaged | Applied | Released |

FIG. 8

INDEPENDENTLY POWERED TROLLEYS

FIELD OF THE INVENTION

This invention pertains to gantry cranes and, in particular, to a control system that allows for independent movement of multiple trolleys on a gantry crane.

BACKGROUND

Mobile gantry cranes are often required to lift loads at four or more lifting points. In these cases, the crane is supplied with a dual trolley and hook block assembly. The typical dual trolley arrangement has an unadjustable fixed distance between the trolleys. This can be a disadvantage if the distance between the lift points on a product to be lifted varies. For this reason, a system that allows for the multiple trolleys to be independently powered so as to allow for an adjustment of the distance between lift points would be an important improvement in the art.

BRIEF SUMMARY

Disclosed is a trolley control system for a gantry crane having a multiple trolley arrangement such as a first and second trolley. The control system includes a trolley beam connected to the gantry crane. A first drive device is connected to the trolley beam. This first drive device is powered by a first drive system. A second drive device is also connected to the trolley beam. The second drive device can be powered by either the first drive system or the second drive system. A first trolley is connected to the first drive device while a second trolley is connected to the second drive device.

In another embodiment, the front control system includes the trolley beam connected to the gantry crane, a first drive device, a first drive system, a second drive device, a processor and the second drive system. The first drive device is connected to the trolley beam and is powered by the first drive system. A second drive device is also connected to the trolley beam and is powered by the second drive system. In this embodiment the first drive system includes a first motor, a first drive train, a first brake and a first encoder. Similarly, the second drive system includes a second motor, a second drive train, a second brake and a second encoder.

BRIEF DESCRIPTION OF THE DRAWINGS

The above and other features and advantages of the present invention will become more apparent by describing in detail exemplary embodiments thereof with reference to the attached drawings in which:

FIG. 3 is a table showing the various operating modes of the trolley control system of FIG. 2;

FIG. 5 is a table showing the various operating modes of the trolley control system of FIG. 4;

FIG. 8 is a table showing the various operating modes of the trolley control system of FIG. 7.

DETAILED DESCRIPTION OF THE EMBODIMENTS

Figure 1:
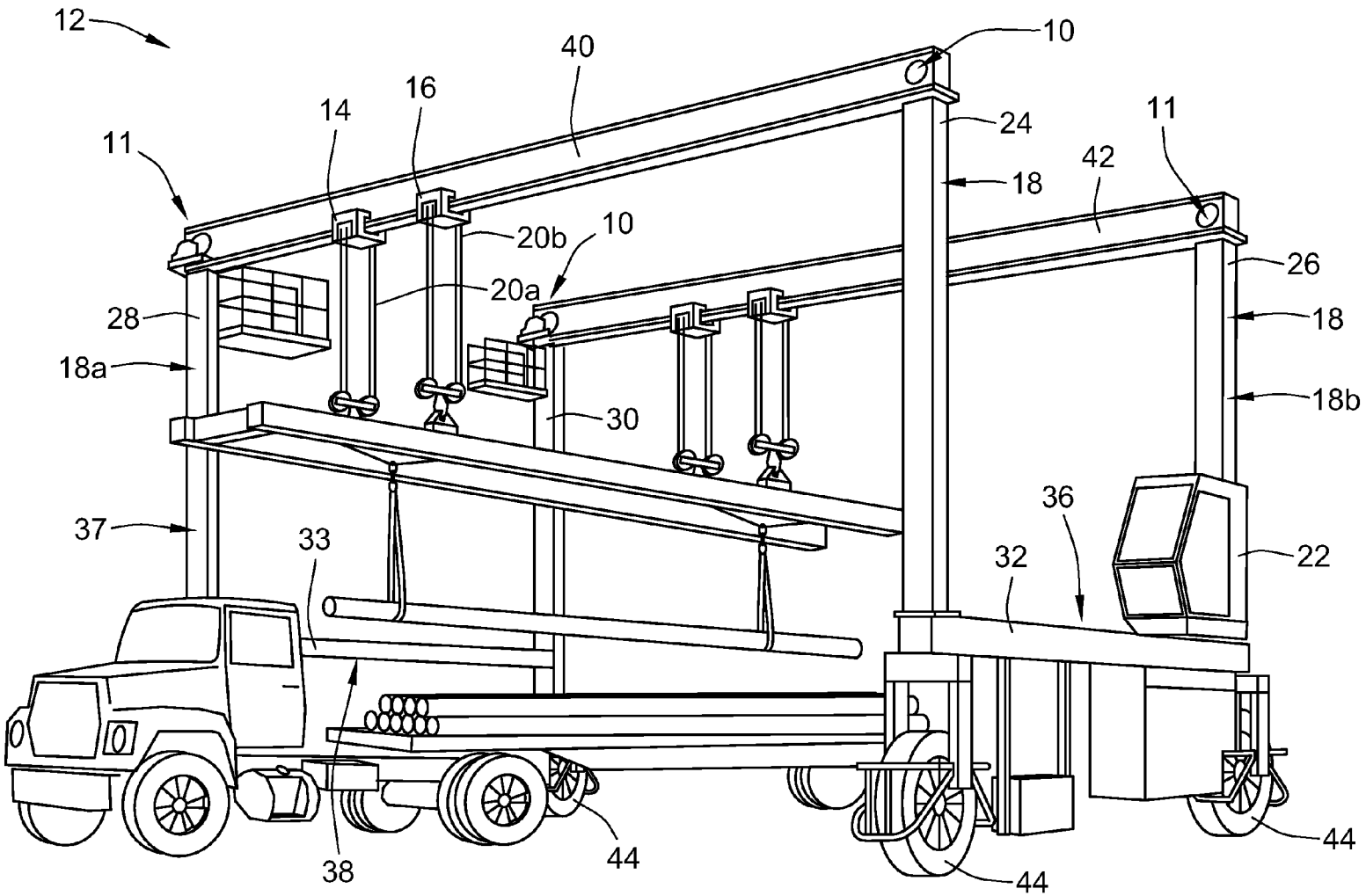
FIG. 1 is a perspective view of one embodiment of a gantry crane with a multiple trolley arrangement.

The following illustrates the invention but, of course, should not be construed as in any way limiting its scope. Disclosed is a trolley control system 10, 11 for a gantry crane 12 having a multiple trolley arrangement such as at least one first 14 trolley and at least one second trolley 16. As shown in the embodiment illustrated in FIG. 1, the gantry crane 12 may be comprised of a gantry structure 18, load lifting apparatus 20*a*, 20*b* connected to the first and second trolleys 14, 16 and an operator cab 22. The trolleys 14, 16 are connected to the gantry structure 18. Lifting apparatus 20*a* is connected to the first trolley 14 and lifting apparatus 20*b* is connected to the second trolley 16. The operator cab 22 may be mounted on the gantry structure 18.

The gantry structure 18 illustrated in FIG. 1 comprises four vertical legs 24, 26, 28, and 30. Legs 24 and 26 may be connected near their bottom ends by a lower side beam 32. Legs 28 and 30 may be similarly connected near their bottoms ends by a lower side beam 33.

As shown in FIG. 1, legs 24 and 26 and the connecting lower side beam 32, define a first side support frame 36. Legs 28 and 30, and the connecting lower side beam 33 define a second side support frame 38.

The legs 24 and 28 are interconnected by a trolley beam 40. The trolley beam 40 is preferably an I-beam mounted at the top of legs 24 and 28 at the front end 18*a* of the gantry structure 18. As further disclosed in FIG. 1, a trolley beam 42, spanning between legs 26 and 30, is provided at a rear end 18*b* of the gantry structure 18. The trolley beam 42 is preferably an I-beam mounted at the top of legs 26 and 30. The invention is not limited to the use of I-beam for the trolley beams 40, 42 and other suitable beams may be used.

The gantry structure 18, thus formed, is an open box-like structure sufficient to span over adjacent loads, such as two railcars or a railcar adjacent a truck trailer. The benefits of the present invention, however, can be realized with other gantry structures. For instance, a two-legged gantry structure utilizing only one trolley beam and one or more trolleys could also be used. Thus, each side support frame would include one leg, and the leg of each side support frame would be connected by a beam.

The gantry structure 18 is also equipped with four (4) wheels 44. One wheel 44 is located at a bottom end of each of the vertical legs 24, 26, 28 and 30. The wheels 44 are powered by hydraulic motors (not shown) to make the gantry crane 12 self-mobile. The wheels 44 may also be railroad wheels that ride on railroad tracks. The gantry structure 18 may also be equipped with link-belt type tracks as used on many boom-type cranes. Other types of motors, such as electrical motors, may also be used to drive the wheels to achieve mobility for the gantry crane 12.

Figure 2:
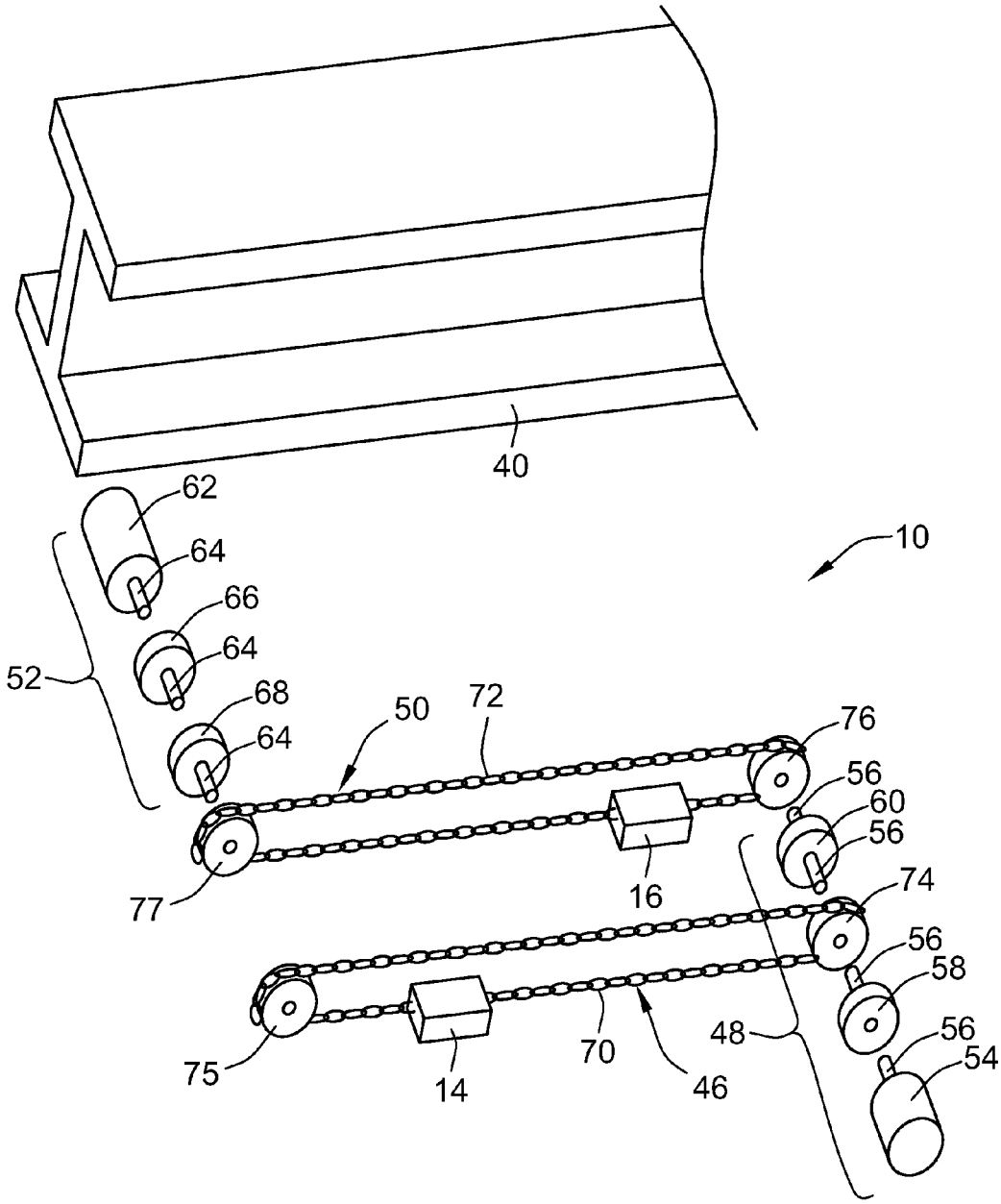
FIG. 2 is an exploded view showing one embodiment of a trolley control system.

For the embodiment shown in FIG. 1, there is both a front control system 10 and a back control system 11. The control systems 10, 11 function similarly and thus only the front control system 10 will be discussed below. The description of the front control system 10 is applicable to the back control system 11. As shown in FIG. 2, the front control system 10 includes trolley beam 40 connected to the gantry crane 12 (not shown). In an embodiment the front control system 10 further comprises a first drive device 46, a first drive system 48, and a second drive device 50. In the preferred embodiment, the front control system 10 also includes the second drive system 52. Similarly, the back control system 11 includes trolley beam 42 connected to the gantry crane 12. In an embodiment the back control system 11 further comprises a first drive device 46, a first drive system 48, and a second drive device 50. In the preferred embodiment, the back control system 11 also includes the second drive system 52.

The first drive device 46 is connected to the trolley beam 40. This first drive device 46 is powered by the first drive system 48 (FIG. 2). The second drive device 50 is also connected to the trolley beam 40. The second drive device 50 may be powered by either the first drive system 48 or the second drive system 52 (FIG. 2). A first trolley 14 is connected to the first drive device 46 while a second trolley 16 is connected to the second drive device 50. In the preferred embodiment the first drive device 46 comprises a first drive chain 70, a first drive sprocket 74 and a first idler sprocket 75, and the second drive device 50 comprises a second drive chain 72, a second drive sprocket 77 and a second idler sprocket 76. In the embodiment shown in FIG. 2, the first drive system 48 rotates the first drive sprocket 74 that engages the first drive chain 70 and the second drive system 52 rotates the second drive sprocket 77 that engages the second drive chain 72.

In an embodiment, as shown in FIG. 2, the first drive system 48 includes a first motor 54, a first drive train 56, a first brake 58 and a first clutch 60. The first motor 54 is attached to a first drive train 56, the first brake 58 is connected to the drive train 56, and the first clutch 60 is connected to the drive train 56. The first clutch 60 is positioned between the first drive device 46 and the second drive device 50. In one embodiment, the first motor 54, the first brake 58, and the first clutch 60 are aligned along a common axis.

As shown in FIG. 2, the second drive system 52 includes a second drive motor 62, a second drive train 64, a second brake 66 and a second clutch 68. The second motor 62 is attached to the second drive train 64, the second brake 66 is connected to the second drive train 64, and the second clutch 68 is connected to the second drive train 64. The second motor 62, the second brake 66, and the second clutch 68 may also be aligned along a common axis. Both the first and second motors 54, 62 may be remotely controlled from a control panel in an operator's cab 22, as shown in FIG. 1. In an embodiment, when the first clutch 60 is disengaged, the first brake 58 is applied to the drive train 56, and the first motor 54 is stationary when the second motor 62 is in operation.

When in operation, the first drive system 48 is capable of operating both the first and second trolley 14, 16 at the same time. As shown in FIG. 3, this is accomplished by having the first motor 54 in operation driving the first drive train 56 while the second motor 62 is in a stationary or idle position. In this mode, the first and second brakes 58, 66 are released from the respective first and second drive trains 56, 64 while the first clutch 60 is engaged with the first drive train 56 and the second clutch 68 is disengaged from the second drive train 64. This arrangement allows the first motor 54 to drive both the first drive sprocket 74 and the second idler sprocket 76 and their associated chains 70, 72, thereby controlling movement of both the first and second trolleys 14, 16.

In another operating mode, as shown in FIG. 3, the first motor 54 operates only the first trolley 14 while the second trolley 16 remains stationary. This is accomplished by having the first motor 54 driving the first drive train 56 while the second motor 62 is in a stationary or idle position. In this mode, however, while the first brake 58 is released from the first drive train 56, the second brake 66 is applied to the second drive train 64, thereby preventing the second drive train 64 from turning. The first clutch 60 is disengaged from the first drive train 56 while the second clutch 68 is engaged with the second drive train 64. Because the first clutch 60 is disengaged, the first motor only drives the first drive sprocket 74 and not the second idler sprocket 76.

In still another operating mode, the second drive system 52 operates only the second trolley 16 while the first trolley 14 remains stationary. As shown in FIG. 3, this is accomplished when the first motor 54 is in a stationary or idle position and the second motor 62 is driving the second drive train 64. In this mode, the first brake 58 is applied to the first drive train 56, thereby preventing it from turning while the second brake 66 is released. The first clutch 60 is disengaged from the first drive train 56 while the second clutch 68 is engaged with the second drive train 64 thus allowing the second drive sprocket 77 to be driven by the second motor 62.

As described above, this trolley control system 10 allows a gantry crane 12 operator to: (1) maneuver both a first and a second trolley 14, 16 simultaneously using a single motor and drive system; or (2) maneuver each of the trolleys 14, 16 independent of one another using a separate drive system for each trolley 14, 16.

In similar alternative embodiments, the first and second drive devices 46, 50 may utilize drive belts instead of chains (and rollers instead of sprockets) or any other suitable material or construction without departing from the spirit and scope of the invention. In such an embodiment, the control system 10 for a gantry crane 12 with a first and second trolley 14, 16 arrangement is disclosed wherein the control system 10 includes a trolley beam 40 connected to the gantry crane 12, a first drive device 46, a first drive system 48, and a second drive device 50. In the preferred embodiment, the front control system 10 also includes the second drive system 52. The first drive device 46 is mounted to the trolley beam 40 and is powered by a first drive system 48. In an embodiment, the first drive device 46 is comprised of a drive belt, drive roller and idler roller and the second drive device 50 is comprised of a drive belt, a drive roller and an idler roller. The first drive system 48 is comprised of a first motor 54, a first drive train 56, a first brake 58 and a first clutch 60. The first motor 54 is attached to the first drive train 56. The first brake 58 is also connected to the first drive train 56. The first clutch 60 is connected to the first drive train 56 and is positioned between the first drive device 46 and the second drive device 50.

The second drive device 50 is mounted to the trolley beam 40. The second drive device 50 may be powered by either the first drive system 48 or the second drive system 52 depending on the operating mode selected. Similar to above, the second drive system 52 includes a second drive motor 62 that is attached to a second drive train 64, a second brake 66 that is connected to the second drive train 64, and a second clutch 68 that is also connected to the second drive train 64. First and second trolleys 14, 16 are connected to the first and second drive devices 46, 50, respectively.

Figure 4:
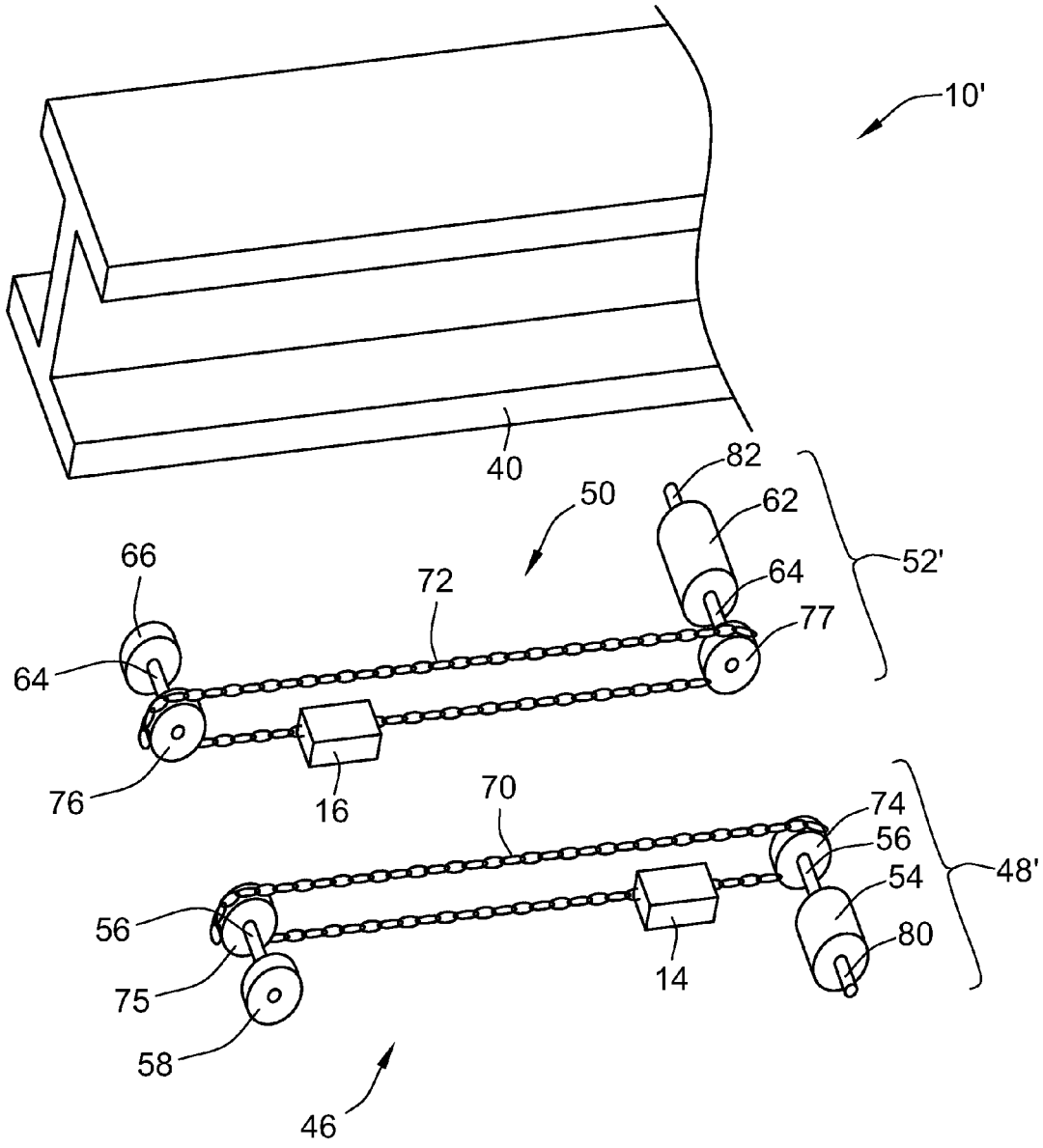
FIG. 4 is an exploded view showing another embodiment of a trolley control system.

FIG. 4 illustrates an alternative embodiment of the control systems 10, 11 used with the gantry crane 12 having a plurality of trolleys. Since control systems 10' and 11' function similarly, only the front control system 10' will be discussed below. The description below of this embodiment of control system 10' is also applicable to the back control system 11'. In this alternative embodiment of the control system 10' shown in FIG. 4, the clutches 60, 68 in the embodiment of FIG. 2 have been removed, encoders have been added and the first and second drive systems are mechanically independent of each other. The embodiment of the front control system 10', illustrated in FIG. 4, includes the trolley beam 40 mounted to the gantry crane 12 (not shown). The front control system 10' further comprises a first drive device 46, a first drive system 48', a second drive device 50, a processor 90 (FIG. 6) and the second drive system 52'. The first drive device 46 is mounted to the trolley beam 40 and is powered by the first drive system 48'. A second drive device 50 is also mounted to the trolley beam 40. The second drive device 50 is powered by the second drive system 52'. The first trolley 14 is connected to the first drive device 46 while a second trolley 16 is connected to the second drive device 50. In an embodiment the first drive device 46 comprises a first chain 70, a first drive sprocket 74 and a first idler sprocket 75, and the second drive device 50 comprises a second drive chain 72, a second drive sprocket 77 and a second idler sprocket 76.

In this embodiment the first drive system 48' includes a first motor 54, a first drive train 56, a first brake 58 and a first encoder 80. The first motor 54 is attached to a first drive train 56 which is connected to the first drive sprocket 74. The first brake 58 is connected to the first drive train 56, which is attached to the first idler sprocket 75, and the first encoder 80 is connected to the first motor 54. Similarly, the second drive system 52' includes a second motor 62, a second drive train 64, a second brake 66, and a second encoder 82. The second motor 62 is attached to the second drive train 64 which is connected to the second drive sprocket 77. The second brake 66 is connected to the second drive train 64, which is attached to the second idler sprocket 76, and the second encoder 82 is connected to the second motor.

In this embodiment, the first motor 54 and the first brake 58 are not necessarily required to be aligned on a common axis. Likewise, the second motor 62 and the second brake 66 are not necessarily required to be aligned on a common axis. The brake's positions are shown for illustrative purposes. The respective brakes 58 and 66 can also be mounted at sprockets 74 and 77 instead of sprockets 75 and 76 without violating the scope and intention of the invention. The first drive system 48' drives the first drive sprocket 74 that engages the first chain 70 causing the first trolley 14 to move and the second drive system 52' drives the second drive sprocket 77 that engages the second chain 72 causing the second trolley 16 to move. In other embodiments, the first and second drive devices 46, 50 may utilize drive belts and rollers instead of chains and sprockets or any other suitable material or construction without departing from the spirit and scope of the invention.

Figure 6:
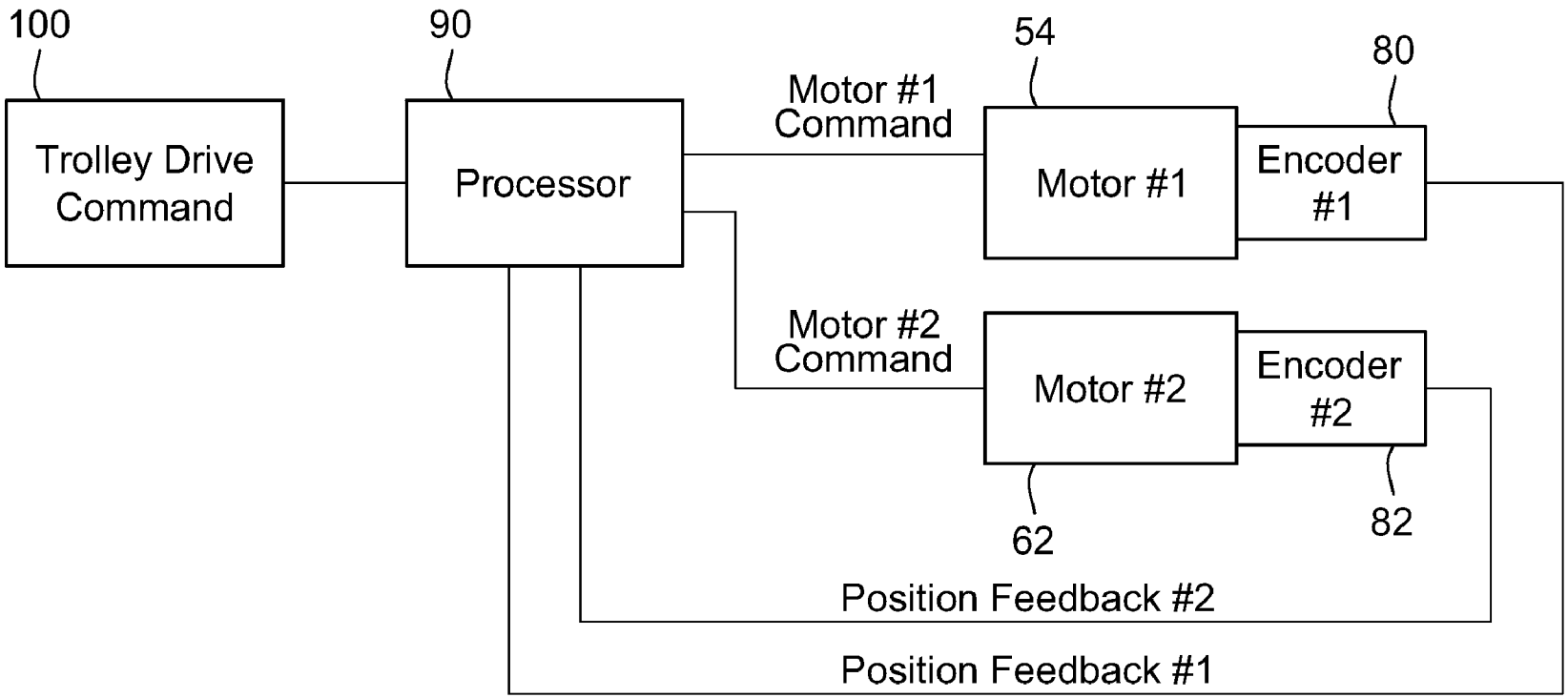
FIG. 6 is a block diagram of the embodiment of the trolley control system of FIG. 4.

As shown in FIG. 6, a controller or processor 90 may be connected to the both the first motor 54 and the second motor 62 of the embodiment shown in FIG. 4. The processor 90 receives commands from the trolley drive command 100. The trolley drive command 100 may send commands to the processor to move both trolleys at the same time, to move only the first trolley 14, or to move only the second trolley 16. The processor then controls the appropriate motor for the movement required. Both the processor 90 and the trolley drive command 100 may be located remotely from the first and second drive systems 48', 52'. In some embodiments, the processor and the trolley drive command may be both located in the operator's cab 22.

In scenarios where it is desired that the first and second trolleys 14, 16 of the embodiment of FIG. 4 move together, the movement of the first and second trolleys 14, 16 is synchronized by the processor 90 (FIG. 6). As shown in FIGS. 5-6, this is accomplished by having processor initiate a command to the first motor 54 to drive the first drive train 56 and to initiate a command to the second motor 62 to drive the second drive train 64. In this mode, the processor causes the first and second brakes 58, 66 to be released from the respective first and second drive trains 56, 64. Thus the first motor 54 causes rotation of the first sprocket 74 and movement of the chain 70. Similarly, the second motor 62 rotates the second drive sprocket 77 and causes movement of its associated chain 72, thereby controlling movement of both the first and second trolleys 14, 16. The processor 90 commands to each motor are based on operator commands received by the processor 90 from the trolley drive command 100 as modified by the feedback provided from the encoders.

Because of wearing of the mechanical parts and/or uneven weight distribution of loads, slippage may occur during the movement of the motor shaft, sprocket and/or rollers and, thus, the relative distance between the trolleys may not stay constant during movement. As shown in FIG. 6, encoders 80, 82 are attached to each motor 54, 62 to provide trolley position information to the processor 90. The first encoder provides position information relating to the location of the first trolley and the second encoder 82 provides position information relating to the location of the second trolley 16. The processor 90 compares the position information provided by the first and second encoders 80, 82 to determine whether the distance between the first and second trolleys 14, 16 is generally constant. If the distance between the first and second trolleys 14, 16 is increasing or decreasing, the processor adjusts the operation of one or both motors such that the distance between the moving trolleys 14, 16 remains constant. Information provided by each encoder 80, 82 to the processor 90 may include data on the rotation of the respective motor shaft or may use other methods known in the art to provide position information to the processor 90 from which the position of a trolley 14, 16 may be determined.

In another operating mode, as shown in FIGS. 5-6, the trolley drive command 100 may initiate a command to the processor 90, based on operator input to the trolley drive command 100, to move only the first trolley 14. The processor 90, in turn, initiates a command to the first motor 54 to move the first trolley 14 (by rotating the first drive train 56 and first drive sprocket 74). The processor causes the second motor 62 to be stationary and, thus, the second trolley 16 remains stationary. In this mode, the processor causes the first brake 58 to be released from the first drive train 56, the second brake 66 to be applied to the second drive train 64.

In still another operating mode, as shown in FIGS. 5-6, the trolley drive command 100 may initiate a command to the processor 90 to move only the second trolley 16. The processor 90, in turn, initiates a command to the second motor 62, based on operator input to the trolley drive command 100, to move the second trolley 16 (by rotating the second drive train 64 and second drive sprocket 77). The processor 90 causes the first motor 54 to be stationary or idle while the second motor 62 drives the second drive train 64. In this mode, the processor 90 causes the first brake 58 to be applied to the first drive train 56, and the second brake 66 to be released.

As described above, this trolley control system 10' allows a gantry crane 12 operator to: (1) maneuver both a first and a second trolley 14, 16 simultaneously using multiple motors and drive systems; or (2) maneuver each of the trolleys 14, 16 independent of one another using a separate drive system for each trolley 14, 16.

Figure 7:
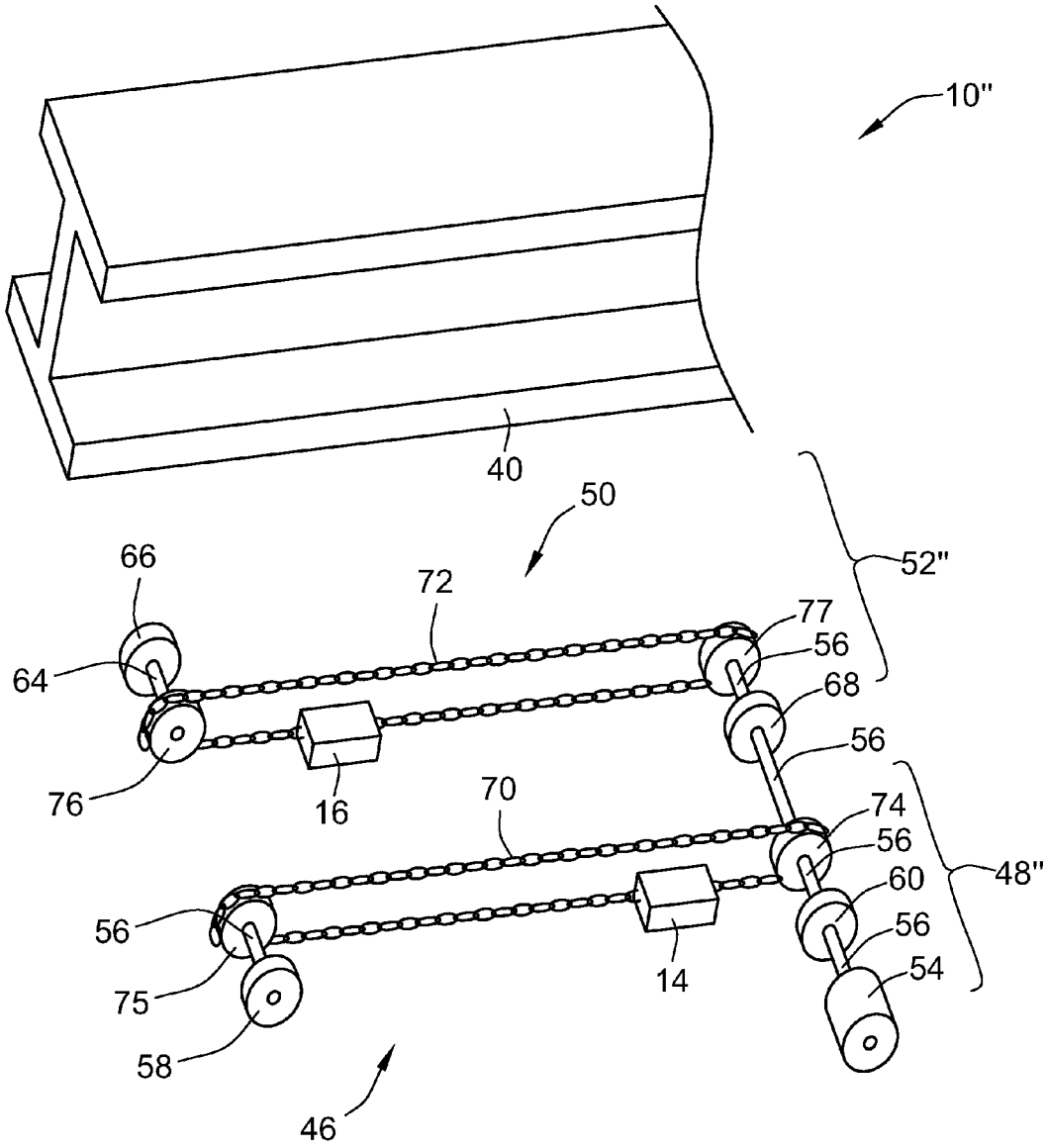
FIG. 7 is an exploded view showing another embodiment of a trolley control system.

FIG. 7 illustrates an alternative embodiment of the control system used with the gantry crane 12 having a plurality of trolleys. Since control systems 10" and 11" function similarly only the front control system 10" will be discussed below. The description below of this embodiment of front control system 10" is also applicable to the back control system 11". The embodiment of the front control system 10", illustrated in FIG. 7, includes the trolley beam 40 mounted to the gantry crane 12 (not shown).

The front control system 10" further comprises a first drive device 46, a first drive system 48", a second drive device 50 and the second drive system 52". The first drive device 46 is mounted to the trolley beam 40 and is powered by the first drive system 48". A second drive device 50 is also mounted to the trolley beam 40 and is powered by the first drive system 48". The first trolley 14 is connected to the first drive device 46 while a second trolley 16 is connected to the second drive device 50. In an embodiment the first drive device 46 comprises a first drive chain 70, a first drive sprocket 74 and a first idler sprocket 75, and the second drive device 50 comprises a second drive chain 72, a second drive sprocket 77 and a second idler sprocket 76.

In the embodiment shown in FIG. 7, the first drive system 48" includes a first motor 54, a first drive train 56, a first brake 58 and a first clutch 60. The first motor 54 is attached to the first drive train 56, the first brake 58 is connected to the drive train 56, and the first clutch 60 is connected to the drive train 56. The first clutch 60 may be positioned between the first motor 54 and the first drive sprocket 74. As shown in FIG. 7, the first motor 54, the first brake 58 and the first clutch 60 are not necessarily aligned along a common axis; other arrangements are within the scope of the invention. The first motor 54 may be remotely controlled from a control panel in an operator's cab 22 (FIG. 1).

As shown in FIG. 7, the second drive system 52" includes a second drive train 64, a second brake 66 and a second clutch 68. The second brake 66 is connected to the second drive train 64 and the second clutch 68 is connected to the second drive sprocket 77 by the first drive train 56. As shown in FIG. 7 the second brake 66 and the second clutch 68 may not necessarily be aligned along a common axis.

When in operation, the first motor 54 is capable of operating both the first and second trolley 14, 16 at the same time. As shown in FIGS. 7-8, this is accomplished by having the first motor 54 in operation driving the first drive train 56. In this mode, the first and second brakes 58, 66 are released from the respective first and second drive trains 56, 64 while the first and second clutches 60, 68 are engaged with the first drive train 56. This arrangement allows the first motor 54 to drive both the first and second drive sprockets 74, 77 and their associated roller chains 70, 72, thereby controlling both the first and second trolleys 14, 16.

In another operating mode, as shown in FIGS. 7-8, the first motor 54 operates only the first trolley 14 while the second trolley 16 remains stationary. This is accomplished by having the first motor 54 driving the first drive train 56 while the first brake 58 is released from the first drive train 56, the second brake 66 is applied to the second drive train 64, thereby preventing the second drive train 64 from turning. The first clutch 60 is engaged with the first drive train 56 while the second clutch 68 is disengaged with the first drive train 56. Because the second clutch 68 is disengaged, the first motor only drives the first drive sprocket 74 and not the second drive sprocket 77.

In still another operating mode, the first motor 54 operates only the second trolley 16 while the first trolley 14 remains stationary. As shown in FIGS. 7-8, this is accomplished when the first motor 54 is driving the first and second drive trains 56, 64. In this mode, the first brake 58 is applied to the first drive train 56, thereby preventing it from turning while the second brake 66 is released. The first clutch 60 is disengaged from the first drive train 56 while the second clutch 68 is engaged with the first drive train 56 thus allowing the second drive sprocket 77 to be driven by the first motor 54.

As described above, this trolley control system 10" allows a gantry crane 12 operator to: (1) maneuver both a first and a second trolley 14, 16 simultaneously using a single motor; or (2) maneuver each of the trolleys 14, 16 individually with a single motor.

In alternative embodiments, the first and second drive devices 46", 50" may utilize drive belts instead of chains (and rollers instead of sprockets) or any other suitable material or construction without departing from the spirit and scope of the invention. While only trolley control system 10 and 11 have been pictured in FIG. 1, alternative embodiments 10' and 10" may be substituted for trolley control system 10 and alternative embodiments 11' and 11" may be substituted for trolley control system 11.

For the purposes of promoting an understanding of the principles of the invention, reference has been made to the preferred embodiments illustrated in the drawings, and specific language has been used to describe these embodiments. However, no limitation of the scope of the invention is intended by this specific language, and the invention should be construed to encompass all embodiments that would normally occur to one of ordinary skill in the art.

The present invention may be described in terms of functional block components and various processing steps. Such functional blocks may be realized by any number of hardware and/or software components configured to perform the specified functions. For example, the present invention may employ various integrated circuit components, e.g., memory elements, processing elements, logic elements, look-up tables, and the like, which may carry out a variety of functions under the control of one or more microprocessors or other control devices. Similarly, where the elements of the present invention are implemented using software programming or software elements the invention may be implemented with any programming or scripting language such as C, C++, Java, assembler, or the like, with the various algorithms being implemented with any combination of data structures, objects, processes, routines or other programming elements. Furthermore, the present invention could employ any number of conventional techniques for electronics configuration, signal processing and/or control, data processing and the like. The words "mechanism" and "element" are used broadly and are not limited to mechanical or physical embodiments, but can include software routines in conjunction with processors, etc.

The particular implementations shown and described herein are illustrative examples of the invention and are not intended to otherwise limit the scope of the invention in any way. For the sake of brevity, conventional electronics, control systems, software development and other functional aspects of the systems (and components of the individual operating components of the systems) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical".

The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

The use of the terms "a" and "an" and "the" and similar referents in the context of describing the invention (especially in the context of the following claims) are to be construed to cover both the singular and the plural. Furthermore, recitation of ranges of values herein are merely intended to serve as a shorthand method of referring individually to each separate value falling within the range, unless otherwise indicated herein, and each separate value is incorporated into the specification as if it were individually recited herein. Finally, the steps of all methods described herein can be performed in any suitable order unless otherwise indicated herein or otherwise clearly contradicted by context.

Numerous modifications and adaptations will be readily apparent to those skilled in this art without departing from the spirit and scope of the present invention.

All references, including publications, patent applications, and patents, cited herein are hereby incorporated by reference to the same extent as if each reference were individually and specifically indicated to be incorporated by reference and were set forth in its entirety herein.

Preferred embodiments of this invention are described herein, including the best mode known to the inventors for carrying out the invention. It should be understood that the illustrated embodiments are exemplary only, and should not be taken as limiting the scope of the invention.

What is claimed is:

1. A trolley control system for a gantry crane having a multiple trolley arrangement, the control system comprised of:

a trolley beam mounted to the gantry crane;

a first drive chain connected to the trolley beam, the first drive chain powered by a first drive system;

a second drive chain connected to the trolley beam, the second drive chain powered by the first drive system and a second drive system;

a first trolley connected to the first drive chain; and a second trolley connected to the second drive chain.

2. The control system of claim 1, wherein the first drive system is comprised of:

a first motor attached to a first drive train;

a first brake connected to the first drive train; and a first clutch connected to the first drive train, said first clutch positioned between the first drive chain and the second drive chain.

3. The control system of claim 2, wherein the first motor, the first brake, and the first clutch are aligned along a common axis.

4. The control system of claim 2, wherein the second drive system is comprised of:

a second motor attached to a second drive train;

a second brake connected to the second drive train; and a second clutch connected to the second drive train.

5. The control system of claim 4, wherein both the first and second motors are remotely controlled from a control panel in an operator's cab.

6. The control system of claim 5, wherein the second motor, the second brake, and the second clutch are aligned along a common axis.

7. The control system of claim 4, wherein the first drive system operates both the first trolley and the second trolley when the first motor is operating the first drive train, the second motor is stationary, the first and second brakes are released from the first and second drive trains, respectively, the first clutch is engaged with the first drive train, and the second clutch is disengaged from the second drive train.

8. The control system of claim 4, wherein the first motor operates only the first trolley when the first motor is operating the first drive train, the second motor is stationary, the first brake is released from the first drive train, the second brake is engaged with the second drive train, the first clutch is disengaged from the first drive train, and the second clutch is engaged with the second drive train.

9. The control system of claim 4, wherein the second drive system operates only the second trolley when the first motor is stationary, the second motor is operating, the first brake is engaged with the first drive train, the second brake is released, the first clutch is disengaged from the first drive train, and the second clutch is engaged with the second drive train.

10. The control system of claim 4, wherein:

the first drive system drives a first drive sprocket that engages the first chain;

and the second drive system drives a second drive sprocket that engages the second chain.

11. The control system of claim 1, wherein the first drive system is comprised of:

a first drive train connected to the first drive chain;

a first motor attached to the first drive train;

a first brake connected to the first drive train; and a first clutch selectively engageable with the first drive train to selectively couple the first drive train to the second drive chain.

12. A control system for a gantry crane having a multiple trolley arrangement, the control system comprised of:

a trolley beam mounted to the gantry crane;

a first drive belt connected to the trolley beam, the first drive belt powered by a first drive system, the first drive system comprised of:

a first motor attached to a first drive train;

a first brake connected to the first drive train; and a first clutch connected to the first drive train, said first clutch positioned between the first drive belt and a second drive belt;

the second drive belt connected to the trolley beam, the second drive belt powered by the first drive system and a second drive system, the second drive system comprised of:

a second motor attached to a second drive train;

a second brake connected to the second drive train; and a second clutch connected to the second drive train;

a first trolley connected to the first drive belt; and a second trolley connected to the second drive belt.

13. The control system of claim 12, wherein:

the first drive system drives a first drive roller that engages the first belt; and the second drive system drives a second drive roller that engages the second belt.

14. The control system of claim 12, wherein the first drive system operates both the first trolley and the second trolley when the first motor is operating the first drive train, the second motor is stationary, the first and second brakes are released from the first and second drive trains, respectively, the first clutch is engaged with the first drive train, and the second clutch is disengaged from the second drive train.

15. The control system of claim 12, wherein the first motor operates only the first trolley when the first motor is operating the first drive train, the second motor is stationary, the first brake is released from the first drive train, the second brake is engaged with the second drive train, the first clutch is disengaged from the first drive train, and the second clutch is engaged with the second drive train.

16. The control system of claim 12, wherein the second drive system operates only the second trolley when the first motor is stationary, the second motor is operating, the first brake is engaged to the first drive train, the second brake is released, the first clutch is disengaged from the first drive train, and the second clutch is engaged with the second drive train.

17. A control system for a gantry crane having a multiple trolley arrangement, the control system comprised of:

a trolley beam mounted to the gantry crane;

a first drive chain connected to the trolley beam, the first drive chain powered by a first drive system, the first drive system comprised of:

a first motor attached to a first drive train;

a first brake connected to the first drive train; and a first encoder connected to the first motor;

the second drive chain connected to the trolley beam, the second drive chain powered by the first drive system and a second drive system, the second drive system comprised of:

a second motor attached to a second drive train;

a second brake connected to the second drive train; and a second encoder connected to the second motor;

a first trolley connected to the first drive chain;

a second trolley connected to the second drive chain; and a processor connected to the first and second motors and to the first and second encoders.

18. The control system of claim 17, wherein the processor controls operation of both the first trolley and the second trolley when the first motor is driving the first drive train, the second motor is driving the second drive train, and the first and second brakes are released from the first and second drive trains, respectively.

19. The control system of claim 17, wherein the first drive system operates the first trolley when the first motor is operating the first drive train, the second motor is stationary, the first brake is released from the first drive train, and the second brake is engaged with the second drive train.

20. The control system of claim 17, wherein the second drive system operates the second trolley when the first motor is stationary, the second motor is operating, the first brake is engaged to the first drive train, and the second brake is released.

21. A trolley control system for a gantry crane having a multiple trolley arrangement, the control system comprised of:

a trolley beam mounted to the gantry crane;

a first drive chain connected to the trolley beam, the first drive chain powered by a first drive system;

a second drive chain connected to the trolley beam, the second drive chain selectively powered by the first drive system and a second drive system;

a first trolley connected to the first drive chain; and a second trolley connected to the second drive chain.

* * * * *